United States Patent [19]

Colby, Jr.

[11] Patent Number: 4,535,047

[45] Date of Patent: Aug. 13, 1985

[54] FERROMAGNETIC AMORPHOUS METAL CARRIER PARTICLES FOR ELECTROPHOTOGRAPHIC TONERS

[75] Inventor: Lewis J. Colby, Jr., Short Hills, N.J.

[73] Assignee: Allied Corporation, Morris Township, Morris County, N.J.

[21] Appl. No.: 482,097

[22] Filed: Apr. 4, 1983

[51] Int. Cl.[3] ..... G03G 9/14

[52] U.S. Cl. ..... 430/108; 430/110; 430/122

[58] Field of Search ..... 430/108, 110, 106.6, 430/122; 75/126 H

[56] References Cited

U.S. PATENT DOCUMENTS

| | | | |
|---|---|---|---|
| 3,778,262 | 12/1973 | Queener et al. | 96/1 |
| 3,873,355 | 3/1975 | Queener et al. | 117/201 |
| 3,918,968 | 11/1975 | Kukla et al. | 96/1.5 |
| 3,922,382 | 11/1975 | Kukla et al. | 427/58 |
| 3,947,271 | 3/1976 | Munzel et al. | 96/1 |
| 4,076,857 | 2/1978 | Kasper et al. | 427/18 |
| 4,306,908 | 12/1981 | Takayama et al. | 73/126 H |

FOREIGN PATENT DOCUMENTS

| | | | |
|---|---|---|---|
| 88459 | 6/1982 | Japan | 430/108 |
| 168256 | 10/1982 | Japan | 430/108 |

*Primary Examiner*—John E. Kittle
*Assistant Examiner*—John L. Goodrow
*Attorney, Agent, or Firm*—James Riesenfeld; Gerhard H. Fuchs

[57] ABSTRACT

The present invention is for an improved carrier particles for use in electrophotographic reproduction machines. The improvement is a core of amorphous ferromagnetic metal. It is preferred that the carrier particles of the present invention are flat.

10 Claims, 8 Drawing Figures

FIG-1.1 PRIOR ART
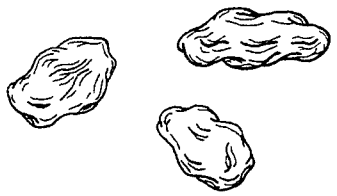
FIG-1.2 PRIOR ART
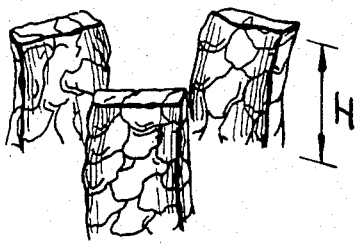
FIG-2.1 PRIOR ART
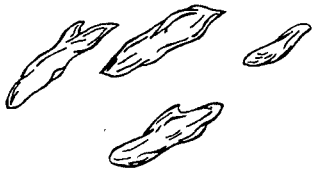
FIG-2.2 PRIOR ART
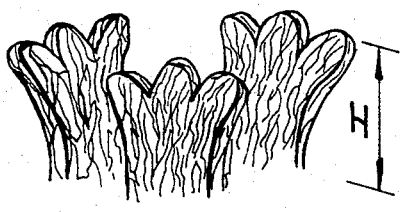
FIG-3.1 PRIOR ART
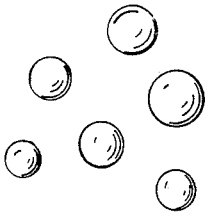
FIG-3.2 PRIOR ART
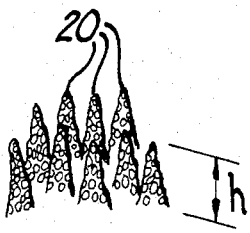
FIG-4.1
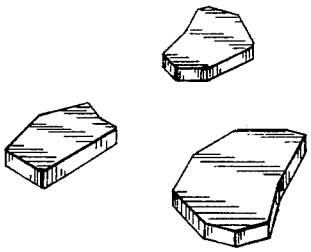
FIG-4.2
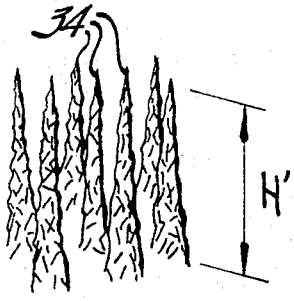

FERROMAGNETIC AMORPHOUS METAL CARRIER PARTICLES FOR ELECTROPHOTOGRAPHIC TONERS

DESCRIPTION

Field of Invention

The present invention relates to electrophotographic development carrier particles, and in particular to a development carrier particle having an amorphous metal core.

BACKGROUND ART

Carrier particles have been used for various electrophotographic processes. The cascade and the magnetic brush are the principal electrophotographic processes in current use which employ carrier particles.

The cascade process is relatively slow; however, it has an advantage in that the materials employed are inherently less expensive than those employed in the magnetic brush process. The magnetic brush process has an advantage in that it reduces the restriction on copying speed associated with the cascade process, and therefore with the magnetic brush process it is possible to copy more rapidly.

In both the brush and cascade processes the development carrier particles are mixed with toner particles to form a mixture of small toner particles and relatively larger carrier particles.

The carrier particles are coated with a material such as a fluorocarbon. The coating promotes electrostatic adhesion of the toner particles to the carrier particles. When a fluorocarbon coating is used the coated carrier particles are cured by heating them to temperatures generally less than about 425° C.

Since the carrier particles lose their effectiveness if the coating spalls, the life of the carrier particles may be limited by the adhesion of the coating. Spalling of the coating from the carrier particle core can be increased in the magnetic brush process by both increasing the density of the carrier particles, and by the continued agitation of the particles. This increase in density and continued agitation is necessary to assure that the carrier particles are coated by the toner particles and that the toner and carrier particles do not settle and separate.

In the magnetic brush process the magnetic character of the carrier particle core determines the character of the magnetic brush; therefore the magnetic properties of the carrier particle core determines the response to the magnetic field and limits both the resolution and the copying speed. Among the ferromagnetic materials currently used for carrier particle cores are iron, low carbon steels, silicon steels, magnetic oxides, and other iron base alloys. Providing a carrier particle core with improved magnetic properties could increase both the resolution and operating speed of the magnetic brush process.

It is an object of the present invention to provide a carrier particle which will be more responsive to magnetic fields.

It is another object of the present invention to provide a carrier particle core which is more responsive to magnetic fields and therefore produces a magnetic brush which when used in an electrostatic copying process gives enhanced resolution.

It is still another object of the present invention to provide a carrier particle that will require less agitation to prevent settling.

BRIEF DESCRIPTION OF FIGURES

FIG. 1.1 is a schematic representation of a prior art carrier particle core. The carrier particle core is electrolytic iron.

FIG. 1.2 is a schematic representation of the magnetic brush which forms when the carrier particles shown in FIG. 1.1 are passed through a magnetic field.

FIG. 2.1 is a schematic representation of a second prior art carrier particle core. This carrier particle has a more elongated configuration than does the carrier particle core shown in FIG. 1.1. The carrier particle core is ferrite.

FIG. 2.2 is a schematic representation of the magnetic brush which forms when the carrier particles shown in FIG. 2.1 are passed through a magnetic field.

FIG. 3.1 is a schematic representation of a spherical prior art carrier particle core. The carrier particle core is a low carbon steel.

FIG. 3.2 is a schematic representation of the magnetic brush which forms when the carrier particles shown in FIG. 3.1 are passed through a magnetic field.

FIG. 4.1 is a schematic representation of the carrier particle cores of the present invention. The carrier particles are flat and have an irregular outline which is formed by fracture.

FIG. 4.2 is a schematic representation of the magnetic brush which forms when the carrier particles of the present invention shown in FIG. 4.1 are passed through a magnetic field.

SUMMARY OF INVENTION

The present invention relates to an improved material for the core of carrier particles used in electrophotographic processes.

One embodiment of the present invention relates to an improved carrier particle, the carrier particle core being an amorphous metal. In the preferred embodiment the carrier particle is flat and has an irregular outline which is formed by fracturing planar sections such as ribbons or sheets of amorphous material.

A second embodiment of the present invention relates to an improved electrophotographic system, the improvement comprising the use of flat carrier particles which have an amorphous metal core.

BEST MODE OF CARRYING THE INVENTION INTO PRACTICE

The prior art carrier particles used in the electrophotographic process may have various shapes. The carrier particles may be compact as shown in FIG. 1.1, elongated as shown in FIG. 2.1, or spherical as shown in FIG. 3.1.

In the magnetic brush process the carrier particles are coated with the toner particles by continuous agitation. A mixture of carrier and toner particles is then brought into contact with a surface. The carrier particles are raised from the surface by passing a magnetic field normal to the surface. The raised carrier particles form magnetic brushes. The magnetic brushes that were produced by passing a magnetic field normal to a surface coated with the carrier particles shown in FIGS. 1.1, 2.1, 3.1 and 4.1 are shown in FIGS. 1.2, 2.2, 3.2, and 4.2.

When the non-spherical prior art carrier particles such as illustrated in FIGS. 1.1 and 2.1 are used, the magnetic brush forms in blankets as shown in FIGS. 1.2 and 2.2. When the spherical prior art carrier particles such as shown in FIG. 3.1 are used to form magnetic brushes, individual bristles 20 rather than blankets are formed as is illustrated in FIG. 3.2. It is preferred to have the magnetic brush composed of individual bristles rather than blankets since the individual bristles provide for better resolution. However, although the spherical carrier particles form magnetic brushes composed of individual bristles rather than blankets, the height, h, of the bristles formed by the spherical carrier particles is substantially less than is the height, H, of the blanket formed by the non-spherical prior art carrier particles. It is preferred to have a long magnetic brush length since a longer brush provides for better resolution. Thus while the resolution resulting from individual bristles is preferred, there has not been available a carrier particle which produces a magnetic brush with long individual bristles.

The preferred carrier particles of the present invention are illustrated in FIG. 4.1. These carrier particles differ both in their chemistry and in their geometry from carrier particles of the prior art. The carrier particles of the present invention are amorphous iron base alloys and have flat polyhedral shapes.

When the carrier particles of the present invention are exposed to a magnetic field, the resulting magnetic brush consists of individual bristles 34 as is illustrated in FIG. 4.2. The magnetic brush length H' is generally as long or longer than the blankets height H, formed by the prior art non-spherical carrier particles.

Furthermore, the preferred carrier particles of the present invention form a magnetic brush which is not strongly dependent on particle size distribution. While carrier particles of the present invention will perform over the broad particle size range of −80 to +325 mesh, it is preferred that the carrier particle size range be between −140 and +325 mesh; i.e., they will pass through a screen having a 0.10 mm opening but not through a screen having a 0.04 mm opening.

In addition, because of their shape the carrier particles of the present invention exhibit a reduced tendency to separate during settling.

The carrier particles of the present invention provide an improved response to magnetic fields. This improved response appears to be the result of a high magnetic saturation in combination with a low magnetic coercivity. It is preferred that the carrier particles of the present invention have a magnetic saturation of at least 10 kilogauss and a magnetic coercivity of not greater than 0.2 Oersteds.

Amorphous alloys with these preferred magnetic properties are generally iron base alloys with significant boron and silicon additions.

In order to further illustrate the advantages of the present invention the following examples are offered.

EXAMPLE I

An electrolytic iron powder (nominally 99.9+ weight percent iron) with the particle configuration illustrated in FIG. 1.1 was spread on a substrate. A bar magnetic was passed under the substrate to promote the buildup and collapse of a magnetic brush.

Electrolytic iron has a saturation magnetization of approximately 21 kilogauss, magnetic coercivity of between 0.05 (very high purity) and 1.0 Oersteds, and an electrical resistivity of approximately 10 microhm/cm. Electrolytic iron has a yield strength of about 20,000 psi and therefore is subject to plastic deformation during reduction of the bulk material to powder. Because of this deformation the magnetic coercivity of the powder will generally be higher than that for the iron in bulk. The magnetic coercivity of the iron powder will be in the order of 1 to 2 Oersteds.

Because of the relatively low yield strength of electrolytic iron, the powder will be subject to deformation during agitation of the carrier particles in the magnetic brush process.

A video tape of the magnetic brush formed by the electrolytic iron powder was made. The resulting magnetic brush is illustrated in FIG. 1.2. This magnetic brush forms in blankets rather than individual bristles. Since the magnetic brush is in the form of blankets the ultimate resolution obtained using this powder as a carrier particle will be limited.

EXAMPLE II

A ferrite powder (a ceramic oxide with an inverse spinel structure) with the configuration illustrated in FIG. 2.1 was tested as set forth in Example I.

Ferrites have low saturation magnetization in the range of 2 to 6 kilogauss, low magnetic coercivity in the range of 0.2 Oersteds, and relatively high electrical resistivity in the range of $10^8$ to $10^{15}$ microhm/cm.

Because of the ionic character of the crystal structure ferrite is not readily subject to plastic deformation during reduction of the bulk material to powder. For this reason the magnetic coercivity for the powder is substantially the same as that for the bulk ferrite.

The magnetic brush resulting from use of the ferrite powder is illustrated in FIG. 2.2. While the ferrite powder produced a long brush, the powder rises as blankets rather than as the individual bristles. As in the case of Example I the formation of a magnetic brush in blanket form rather than in the form of individual bristles limits the resolution.

EXAMPLE III

A spherical mild steel powder containing carbon (nominally 1–4 weight percent carbon) with the configuration illustrated in FIG. 3.1 was tested as set forth in Example I.

Mild steels containing carbon generally have saturation magnetizations in the range of 20 to 22 kologauss, magnetic coercivity of between 0.5 and 0.8 Oersteds, and electrical resistivity between 50 and 60 microhm/cm. In powder form, due in part to the high yield strength (e.g. 40,000 to 90,000 psi of these steels and because of the method of powder making, the magnetic coercivity will be substantively the same as that for the bulk material.

The magnetic brush which results from the use of these mild steel powders is illustrated in FIG. 3.2. The magnetic brush is composed of individual bristles 20; however, the bristles are relatively short, and much shorter than the height of the blanket formed by the powders of Examples I & II.

EXAMPLE IV

An amorphous flat powder produced by grinding amorphous ribbon was tested as set forth in Example I.

The composition of the amorphous powder was: 92% Fe, 3% B, and 5% Si in weight percent. The saturation magnetization for this alloy is nominally 16 kilogauss, its magnetic coercivity is 0.05 Oersteds and its electrical resistivity is 130 microhm/cm. Since amorphous alloys have a high yield strength (e.g. 300,000 to 400,000 psi) there is little plastic deformation associated with converting the ribbon to powder. Thus, as with the ferrite and the low carbon steel alloys, the magnetic coercivity of the powder is similar to that of the bulk material.

The magnetic brush resulting from the use of these amorphous powders is illustrated in FIG. 4.2. The powders form a magnetic brush with discrete bristles 34. The magnetic brush has a height which is greater than the height of the magnetic brush of Example III. Thus the magnetic brush formed using the amorphous metal powder of the present invention has both the greater height and individual bristles which provide for greater resolution.

It is also noteworthy that the material is substantially stronger than the prior art material and should therefore resist deformation during agitation.

Example V

The powder of Example IV was heat treated to crystallize the amorphous alloy. After crystallization the magnetic coercivity was substantially increased to typically 5 or more Oersteds. When the experiment of Example I was repeated and a magnetic brush similar to that illustrated in FIG. 4.2 was formed, the powder tended to become permanently magnetized due to the higher magnetic coercivity of the powder. This permanent magnetization substantially reduced the collapsiblity of the resulting brush.

What I claim:

1. An improved two component electrophotographic developer consisting essentially of a toner and a magnetic carrier particle, the improvement comprising:

said development carrier comprising a flat polyhedral shaped particle of a ferromagnetic amorphous metal.

2. The development carrier particle of claim 1 wherein said particle has a magnetic saturation of greater than 15 kilogauss and a magnetic coercivity of less than 0.1 Oersteds.

3. The development carrier particle of claim 2 wherein said particle is comprised of an alloy consisting essentially of iron, boron and silicon.

4. The development carrier particle of claim 3 having a fluorocarbon coating.

5. The development carrier particle of claim 1 wherein said particle has a size such that it will pass through a screen having a 0.10 mm opening but not through a screen having a 0.04 mm opening.

6. In a magnetic brush process system for electrophotographic copying employing a two component developer consisting essentially of a toner and a magnetic particle, the improvement comprising:

said development carrier comprising a flat polyhedral shaped particle of a ferromagnetic amorphous metal.

7. The system of claim 6 wherein said particles have a magnetic saturation of greater than 15 kilogauss and a magnetic coercivity of less than 0.1 Oersteds.

8. The system of claim 7 wherein said particles are comprised of an alloy consisting essentially of iron, boron and silicon.

9. The development carrier particle of claim 8 having a fluorocarbon coating.

10. The system of claim 6 wherein said particles have a size such that they will pass through a screen having a 0.10 mm opening but not through a screen having a 0.04 mm opening.

* * * * *